US005250018A

United States Patent [19]

Chung et al.

[11] Patent Number: 5,250,018

[45] Date of Patent: Oct. 5, 1993

[54] METHOD OF MAKING RECTANGULAR PAPERBOARD PACKAGE

[75] Inventors: Yun H. Chung, Toledo; Dennis E. Chung, Sylvania, both of Ohio

[73] Assignee: Chung Packaging Company, Perrysburg, Ohio

[21] Appl. No.: 978,037

[22] Filed: Nov. 18, 1992

Related U.S. Application Data

[63] Continuation of Ser. No. 882,741, May 7, 1992, abandoned, which is a continuation of Ser. No. 639,835, Nov. 21, 1990, abandoned, which is a continuation-in-part of Ser. No. 326,380, Mar. 21, 1989, Pat. No. 5,011,722, which is a continuation-in-part of Ser. No. 195,367, May 13, 1988, Pat. No. 4,813,545, which is a continuation of Ser. No. 887,562, Jul. 17, 1986, abandoned.

[51] Int. Cl.[5] ..... B31B 3/16; B31B 3/25; B31B 3/46; B31B 3/64

[52] U.S. Cl. ..... 493/59; 493/69; 493/79; 493/134; 493/135; 493/143; 493/187

[58] Field of Search ..... 493/59, 62, 69, 71, 493/72, 74, 79, 81, 87, 133, 134, 135, 143, 167

[56] References Cited

U.S. PATENT DOCUMENTS 3,041,941 7/1962 Danielzig ..... 493/199
4,540,392 9/1985 Junod et al. ..... 493/303
4,929,226 5/1990 Focke et al. ..... 493/343

OTHER PUBLICATIONS

Brochure "Web-Fed Aseptic Packaging System" International Paper Company Mar. 1988 or earlier.

*Primary Examiner*—William E. Terrell
*Attorney, Agent, or Firm*—MacMillan, Sobanski & Todd

[57] ABSTRACT

A liquid tight rectangular paperboard container (10) is provided with a separate opening tab (17) secured to the top panel (15) thereof which enables the package to be opened to provide a fully open top. In particular, an elongate plastic window (18*c*) is formed along the front fold line (15*a*) connecting the top and front panels (15 and 11) of the package, and has ends (18*d*, 18*e*) connected to spaced apart arcuate shaped perforated lines (18*a*, 18*b*) extending to the rear corners of the top panel. In the construction of the package, the opening tab (17) is first ultrasonically welded to the outside surface of the package blank, and then the window section (18*c*) is pressed against and welded to the inside surface of the tab. A slit (40) which is formed in the window enables any air trapped between the window and the tab to escape during the welding operation. The package also includes a unique side sealing flap structure, while the particular paper supply roll from which the package is constructed has a unique structure. Also, a unique method of forming the package is disclosed.

16 Claims, 14 Drawing Sheets

METHOD OF MAKING RECTANGULAR PAPERBOARD PACKAGE

This application is a continuation of Ser. No. 882,741, filed May 7, 1992 abandoned, which is a continuation of Ser. No. 639,835, filed Nov. 21, 1990 abandoned, which is a continuation-in-part of Ser. No. 326,380, filed Mar. 21, 1989, U.S. Pat. No. 5,011,722, which is a continuation-in-part of Ser. No. 195,367, filed May 13, 1988 U.S. Pat. No. 4,813,545, which is a continuation of Ser. No. 887,562, filed Jul. 17, 1986 abandoned.

BACKGROUND OF THE INVENTION

The present invention relates generally to a rectangular paperboard package which is formed from a sheet of paperboard material and, in particular, to a package which is capable of holding a liquid product and is provided with a separate opening tab for enabling the top portion of the package to be completely opened. The present invention also concerns a unique paper supply roll, along with the particular method of making the package.

Paperboard materials are becoming increasingly popular as a packaging material, especially in the food industry. A sheet of paperboard material typically includes a central structural layer of paper to provide strength and rigidity to the associated package. In some instances, a layer of aluminum foil can be adhered to one surface of the paperboard to serve as a barrier layer against the passage of contaminates into the package.

Generally, both surfaces of the paperboard/foil combination are then coated with a heat sealable thermoplastic material. While a number of specific constructions are known, it is generally accepted practice to fold a precut and pre-scored sheet of paperboard material into a predetermined packet configuration, and to the packages by applying heat and pressure to certain contacting surfaces of the paperboard.

Many types of paperboard packages capable of holding a liquid and provided with some type of opening have been proposed. Examples of such packages are disclosed in U.S. Pat. Nos. 3,347,444; 4,317,518; 4,520,929; and 4,546,884. While the packages disclosed in these patents have been found to be satisfactory for certain packaging applications, there has been a need in the industry for a rectangular paperboard package which is capable of holding liquid and which can be produced on an economical basis.

SUMMARY OF THE INVENTION

The present invention relates to a rectangular paperboard package which is fabricated from a sheet of paperboard material. The package can be utilized to package a wide variety of products including liquid drinks, frozen concentrated drinks, motor oil, granular or pulverized material, and containers which have been previously filled with a product. The package is provided with a unique easy open, tear-away top portion which includes a separate tab member which is fastened to the top wall of the container during the construction thereof and enables the top portion of the container to be completely opened.

More specifically, the package is provided with a top panel which is connected to the front panel along a front fold line. An elongated plastic window having at least one air permeable slit formed therein extends along the fold line. A pair of spaced apart, arcuately shaped perforation lines extend between the end of the window and rear corners of the top panel. The opening tab is adapted to completely cover and seal around the window and over the perforated lines. Further, the inside surface of the opening tab is secured to the plastic window by a separate welding operation. The slit(s) formed in the window enable any air trapped between the window and the opening tab to escape during the welding operation. When the opening tab is pulled upwardly, the top panel will be broken along the elongated window and the arcuate shaped perforated lines, and will remain hingedly connected to the package along a rear fold line which connected the top panel to the rear panel of the package. A pair of arcuately-shaped ear portions, which remain attached to the upper marginal upper edges of the side panels of the package, can then be hinged upwardly to fully open the package.

Also, in accordance with the present invention, the side fin seals are provided with extension portions which enable the fin seals to be folded and sealed against the side panels such that the outer edge of the extension portions terminates adjacent side corners of the package. Such a construction provides a substantially free uninterrupted planar surface for printing purposes, protects the associated side fin seal which is covered by the extension portion, and increases the rigidity of the associated panel. Further, the package may be constructed with a unique bottom sealing structure, wherein a single bottom fin seal is formed perpendicular to a plane containing the two parallel side fin seals.

The present invention also includes other unique features, including the particular construction of the paper supply roll from which the individual blanks are constructed, along with the particular method of folding the package.

Other features and advantages of the present invention will be apparent to one skilled in the art from the following detailed description of the invention in conjunction with the attached drawings.

DESCRIPTION OF THE PREFERRED EMBODIMENT

Preliminarily, it should be noted that the package of the present invention can be fabricated from a variety of commercially available laminated materials. Such laminated materials include multiple layers, of which the centermost is typically one or two layers of paper or paperboard. The paper layer can be covered on one or both sides by a thermoplastic material, such as, for example, polyethylene. In instances wherein it is desirable to reduce gas permeation and/or to provide light blocking or acid resistance, an aluminum foil layer is added, and an additional layer of plastic is used to bond it to the paper. Laminated material suitable for producing the package of the present invention are available from James River Corporation of Madison, Wisconsin.

Also, it should be noted that certain terms used herein such as "front", "back", "side", "top" and "bottom" are used to facilitate the description of the preferred embodiment of the invention, and are not intended as a limitation on the position the package may be in at any stage of its fabrication or handling, either before or subsequent to being filled with a product. Also, such terms should not be considered as a limitation regarding the possibility of modifications such as mirror-image fabrication of the package.

Figure 1:
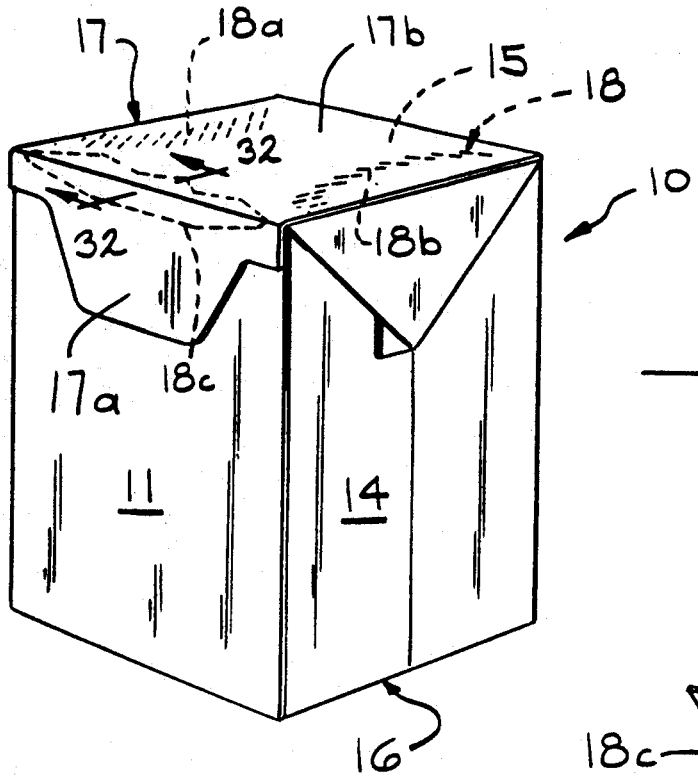
FIG. 1 is a top perspective view which shows a paperboard package according to the preferred embodiment of the invention in an upright position.
Figure 2:
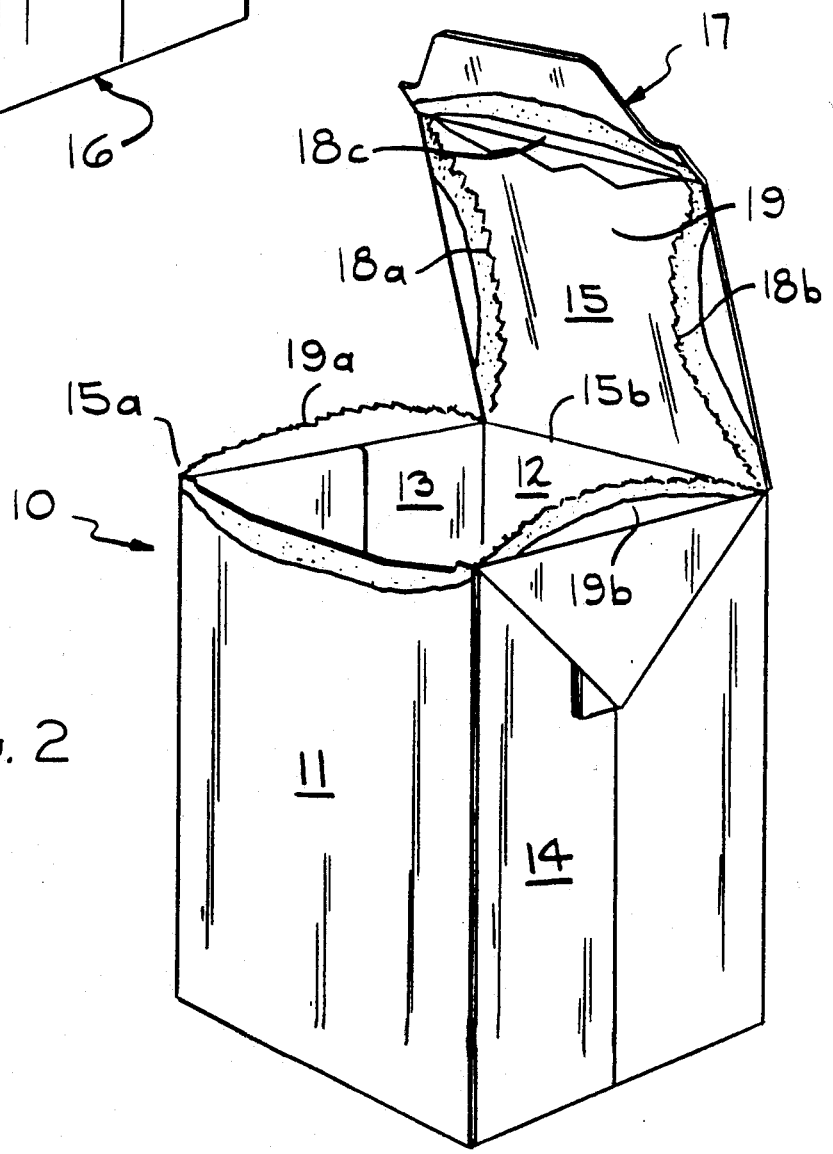
FIG. 2 is a top perspective view which shows the package of FIG. 1 after an opening tab has been pulled upwardly to completely open the top panel.
Figure 31:
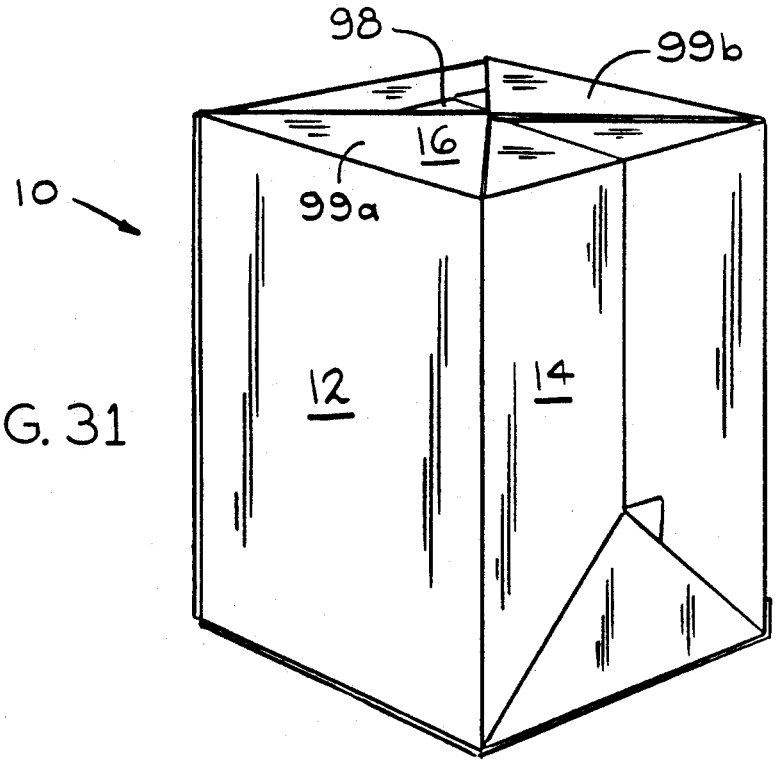
FIG. 31 illustrates a final step in the assembly of the package wherein the upwardly extending transverse bottom seal of FIG. 29 is folded downwardly and the bottom ears are then folded inwardly against the bottom of the package.

Prior to discussing the particular method and details of the fabrication of the package of the present invention, a brief description of the completed package will be discussed. FIG. 1 illustrates a top perspective view of a package 10 according to the invention which is unopened while FIG. 2 illustrates the package 10 with an opened top portion. A bottom perspective view of the completed package 10 is shown in FIG. 31. The package 10 includes a front panel 11, a back panel 12, a first side panel 13, a second side panel 14, a top panel 15, and a bottom panel 16 (panels 12 and 16 best shown in FIG. 31).

As shown in FIG. 1, the top panel 15 and the upper portion of the front panel 11 are covered by a separate opening tab 17, having a front portion 17*a* secured to the upper portion of the front panel 11 and a square top portion secured to and substantially covering the entire top panel 15. The top panel 15 and the upper portion of the front panel 11 are provided with a tear line means 18, which comprises first and second spaced apart and arcuately-shaped tear lines 18*a* and 18*b* which are formed in the top panel and have their one ends connected by a third tear line 18*c* formed along a front fold line 15*a* connecting the top panel 15 to the front panel 11. In the preferred embodiment, the third tear line 18*c* is a plastic window which at least partially covers an elongated opening formed in the center paper layer. The three tear lines 18*a*, 18*b*, and 18*c* cooperate to define an openable portion 19 of the top panel which is hingedly connected to the rear panel 12 along a rear fold line 15*b*. The inner surface of the tab 17 is securely fastened to the window and the outer surface of the openable portion 19 such that, when the front portion 17*a* of the tab 17 is lifted and pulled upwardly, the openable portion 19 is severed along the tear lines 18*a*, 18*b* and 18*c* to completely open the top of the package.

Figure 3:
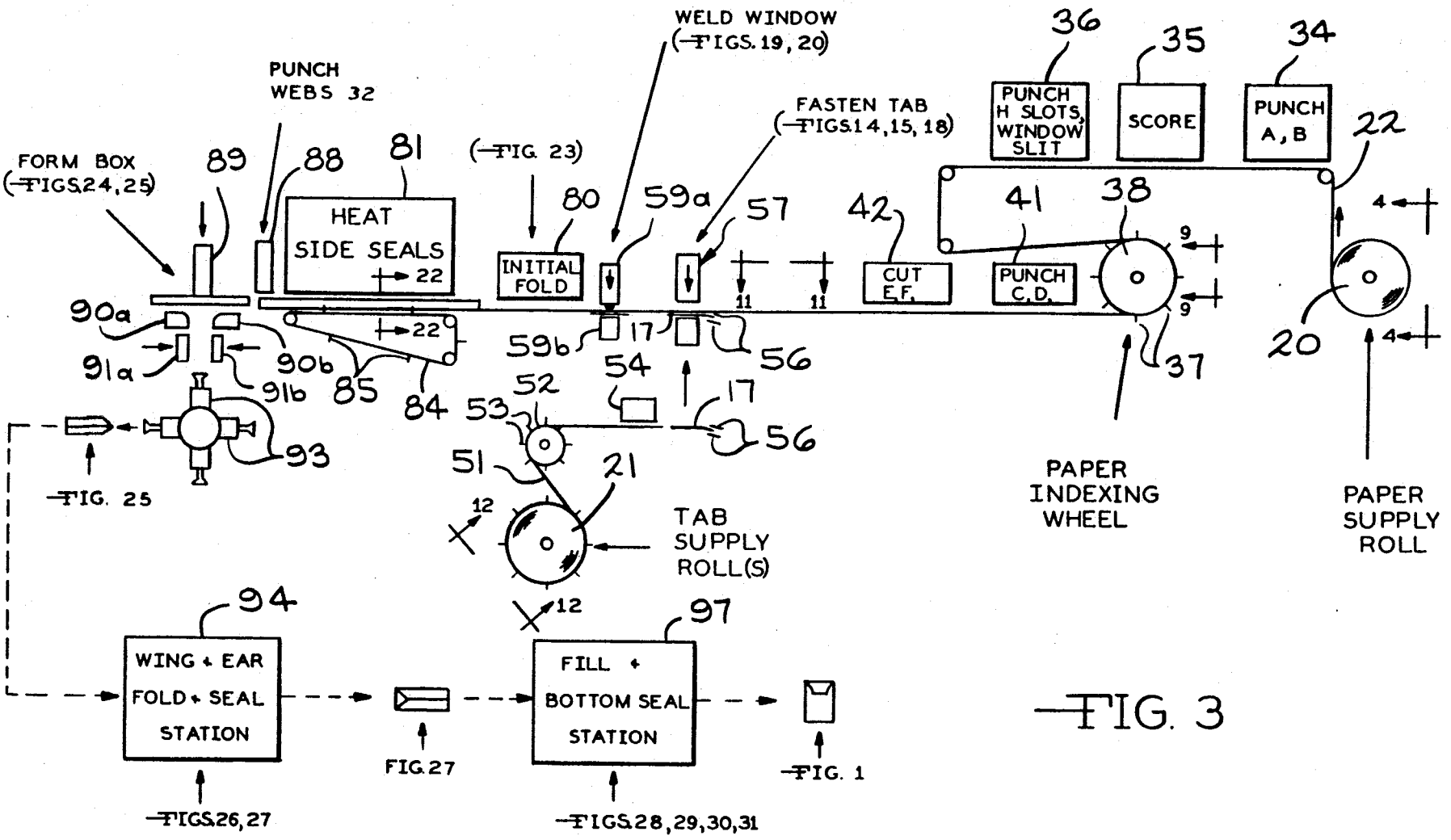
FIG. 3 is a schematic view illustrating the various steps in fabricating a package according to the preferred embodiment of the invention.

Referring now to FIG. 3, there is shown a schematic diagram which generally illustrates the method of manufacture of the package 10. In accordance with the present invention, the main blank of paperboard from which the package is constructed is supplied from a main paper supply roll 20 which has been manufactured in a predetermined manner while the separate opening tabs which are subsequently secured to the main body of the package are fabricated from a separate tab supply roll 21. Both the paper supply roll 20 and the tab supply roll 21 have a unique construction as will be discussed below.

Figure 4:
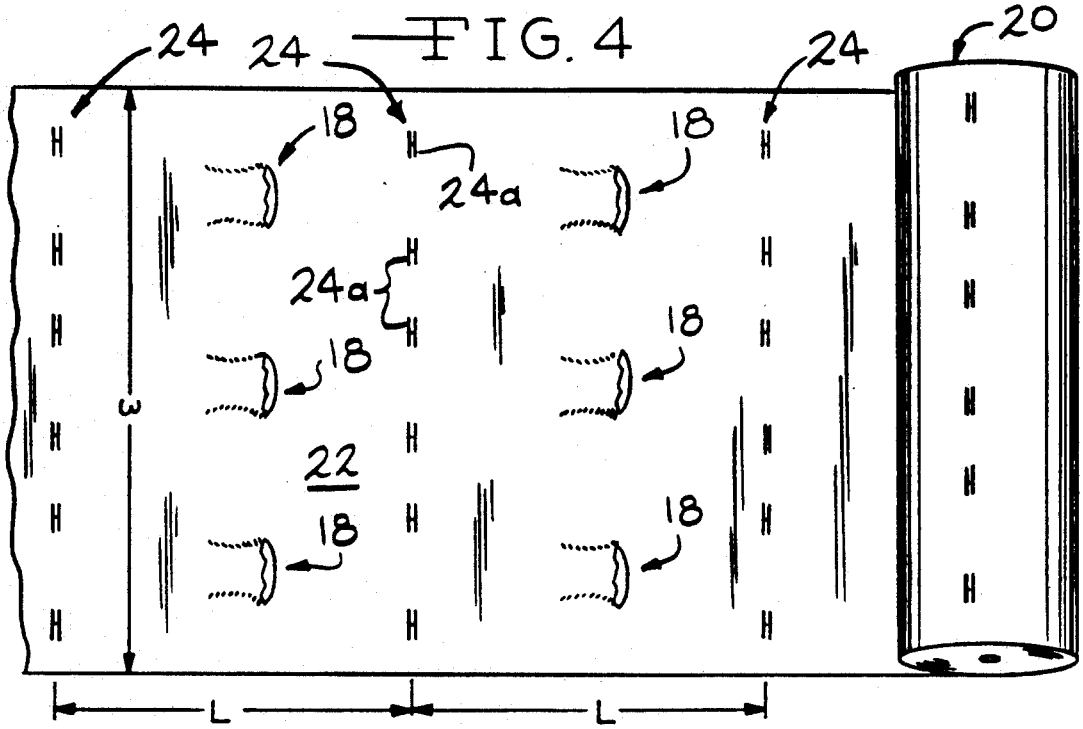
FIG. 4 is a plan view illustrating the construction of the roll of laminated paperboard material which is utilized to produce individual blanks for constructing a plurality of packages.
Figure 5:
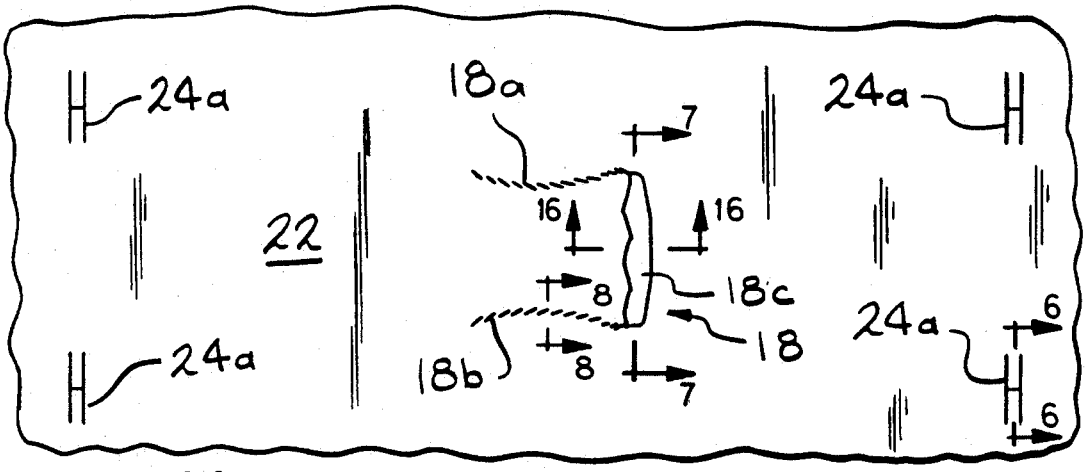
FIG. 5 is an enlarged plan view of a section of the paper supply roll of FIG. 4.
Figure 6:
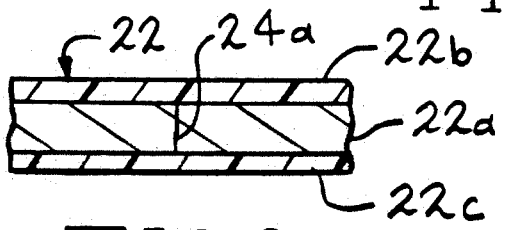
FIG. 6 is a sectional view taken along the line 6—6 of FIG. 5 and illustrating the manner in which the registration means are cut in the center paperboard layer.
Figure 21:
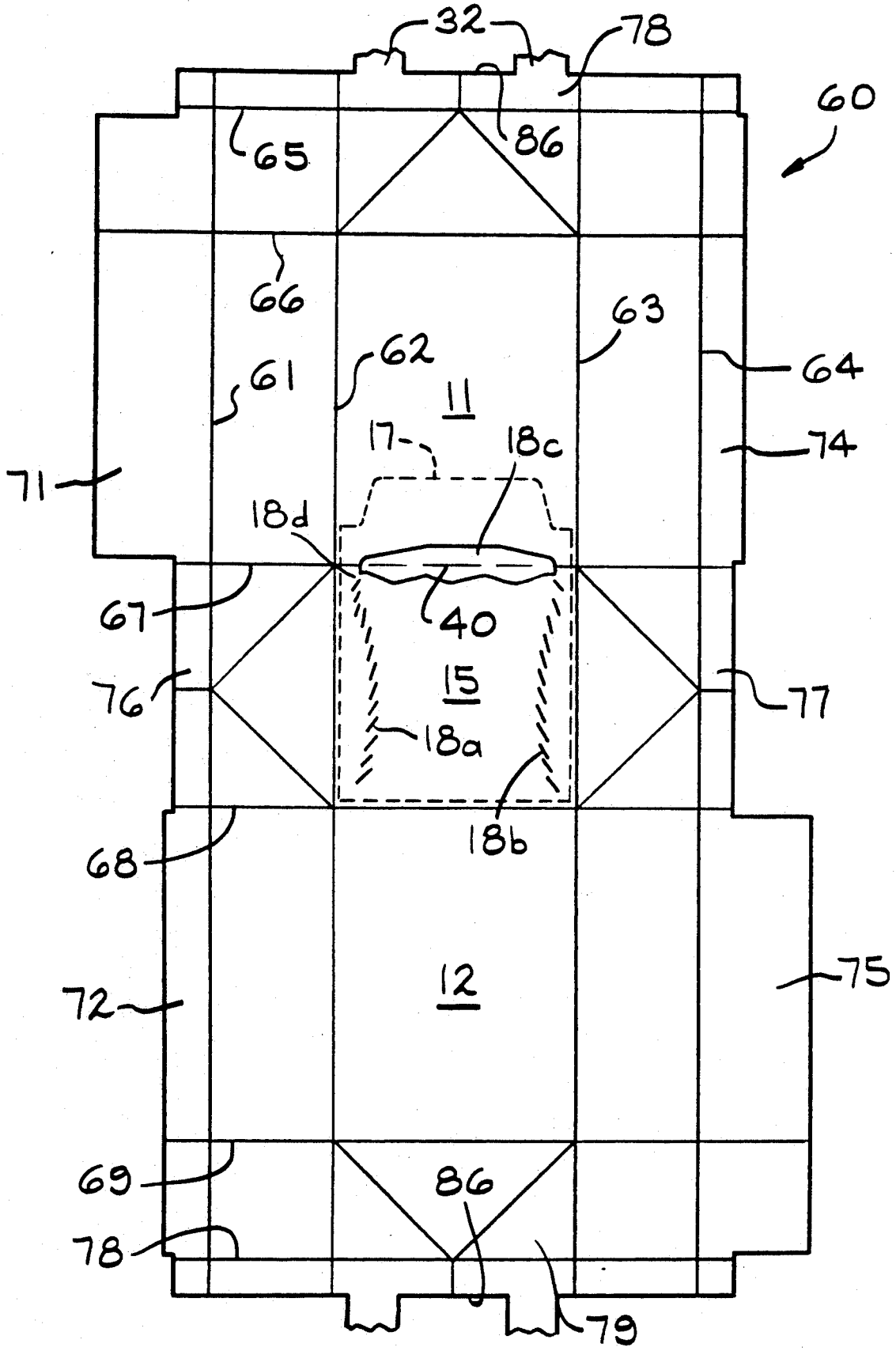
FIG. 21 is an enlarged view of one of the blanks shown in FIG. 11 after an opening tab has been secured thereto.

Referring to FIGS. 4 thru 8, the specific construction of the paper supply roll 20 will now be discussed. FIG. 4 is taken along the line 4—4 of FIG. 3 and illustrates a plan view of a longitudinally extending sheet 22 of paperboard material as it is fed from the supply roll 20 with the upwardly facing surface representing the eventual inside surface of the package. The sheet 22, as shown in FIG. 6, includes a centermost paper layer 22*a*, and inner and outer plastic layer 22*b* and 22*c* respectively. As will be discussed, the thickness of the inner plastic layer 22*b* is typically greater than the thickness of the outer plastic layer 22*c*. The sheet 22 is constructed having a predetermined width W which is a function of the size of the blank required to produce an individual package, and the number of packages which are to be produced simultaneously. In FIG. 4, each predetermined length L of the paper 22 is adapted to provide three individual blanks for producing three separate packages. As will be discussed, as the sheet 22 is fed through the machine, various punching, cutting, and scoring operations are performed on the sheet 22 in order to produce a blank capable of being folded into the package of the present invention. One such blank is shown in FIG. 21 and will be discussed in more detail hereinafter.

In accordance with the present invention, the paper supply roll 20 is provided a plurality of registration or indexing means, generally represented by the reference numeral 24, which provides both a means for indexing and feeding the paper through the machine, and which also maintains precise registration of the paper with respect to various operating stations. As shown in FIG. 4, the indexing means 24 are uniformly longitudinally spaced along the sheet 22 by the distance L. In the embodiment shown in FIG. 4, the indexing means 24 comprises a plurality of precut peg receiving portions 24*a* which extend transversely across the sheet 22. In FIG. 4, six such peg receiving portions 24*a* are shown. Each peg receiving portion, as shown in the enlarged view of FIG. 5, and the sectional view of FIG. 6, consists of a precut "H" pattern which is cut only in the center paperboard layer 22*a*, and is covered by the plastic layers 22*b* and 22*c*. As will be discussed, these precut "H" patterns are later punched out by the machine to form rectangular holes which function as a mechanical means for indexing and registering the feeding of the paper sheet 22 through the machine.

It will be appreciated that, in some instances, it may be desirable to provide more or less than six peg receiving portions along the sheet. Also, while the indexing means has been illustrated in FIG. 4 as peg receiving portions which have been cut into the paperboard during the manufacturing of the roll of paperboard, it may be desirable to cut the peg receiving portions after the plastic layers have been applied, or to print the sheet 22 with eye marks which are electronically or optically detected by the machine and are utilized to register the roll of paper for punching out the peg receiving portions after the paper roll has been mounted on the machine.

Figure 7:
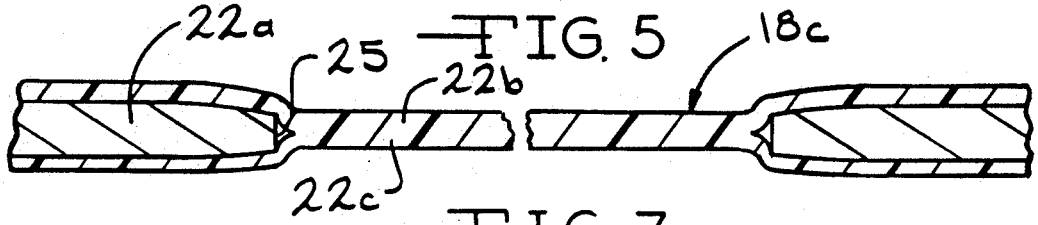
FIG. 7 is a sectional view taken along the line 7—7 of FIG. 5 and illustrating the manner in which the center paperboard layer is cut such that, when the inner and outer plastic layers are extruded thereon, the plastic layers become fused together to form a "window"
Figure 8:
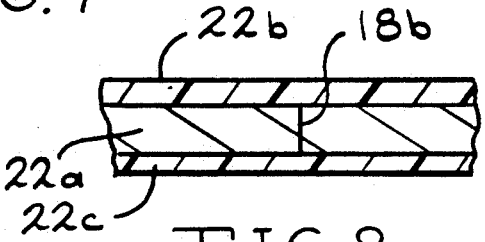
FIG. 8 is a sectional view taken along the line 8—8 of FIG. 5 and showing that the perforation lines connected to the ends of the window extend completely through the center paperboard layer, but do not extend into either the inner or outer plastic layers.

The paper sheet 22 also includes a plurality of the tear line means 18 discussed above with reference to FIGS. 1 and 2, which are longitudinally spaced apart with at least one tear line means 18 located between each longitudinally successive pair of indexing means 24. In the embodiment of FIG. 4, since the sheet is used to provide three blanks at a time, three such tear line means 18 are aligned transversely to one another for each predetermined length L of the paper sheet 22. As shown in FIG. 5, and as previously discussed, each tear line means includes first and second arcuately-shaped tear lines 18*a* and 18*b* which are connected by the plastic window 18*c*. In the preferred embodiment of the invention, the first and second tear lines 18*a* and 18*b*, as shown in FIG. 5, include arcuate perforation patterns wherein, as shown in FIG. 8 the perforations extend completely through the centermost paper layer 22*a*, but do not extend into either the inner or outer plastic layers 22*b* and 22*c*. While in some instances it may be desirable to provide a third tear line 18*c* as a similar perforation pattern, in the preferred embodiment of the invention, the third tear line 18*c* is a plastic window formed by punching an elongate opening 25 in the centermost paper layer 22*a* prior to applying the inner and outer plastic layers 22*b* and 22*c* to the paper layer. Preferably, as shown in FIG. 5, the window includes V-shaped sections 18*d* and 18*e* which extend longitudinally from the ends of the window into the perforated tear lines 18*a* and 18*b* respectively. Thus, as shown in FIG. 7, when the inner and outer plastic layers are extruded onto opposite sides of the paper, they will bond together to form the plastic window 18*c* in the paper sheet 22.

Figure 11:
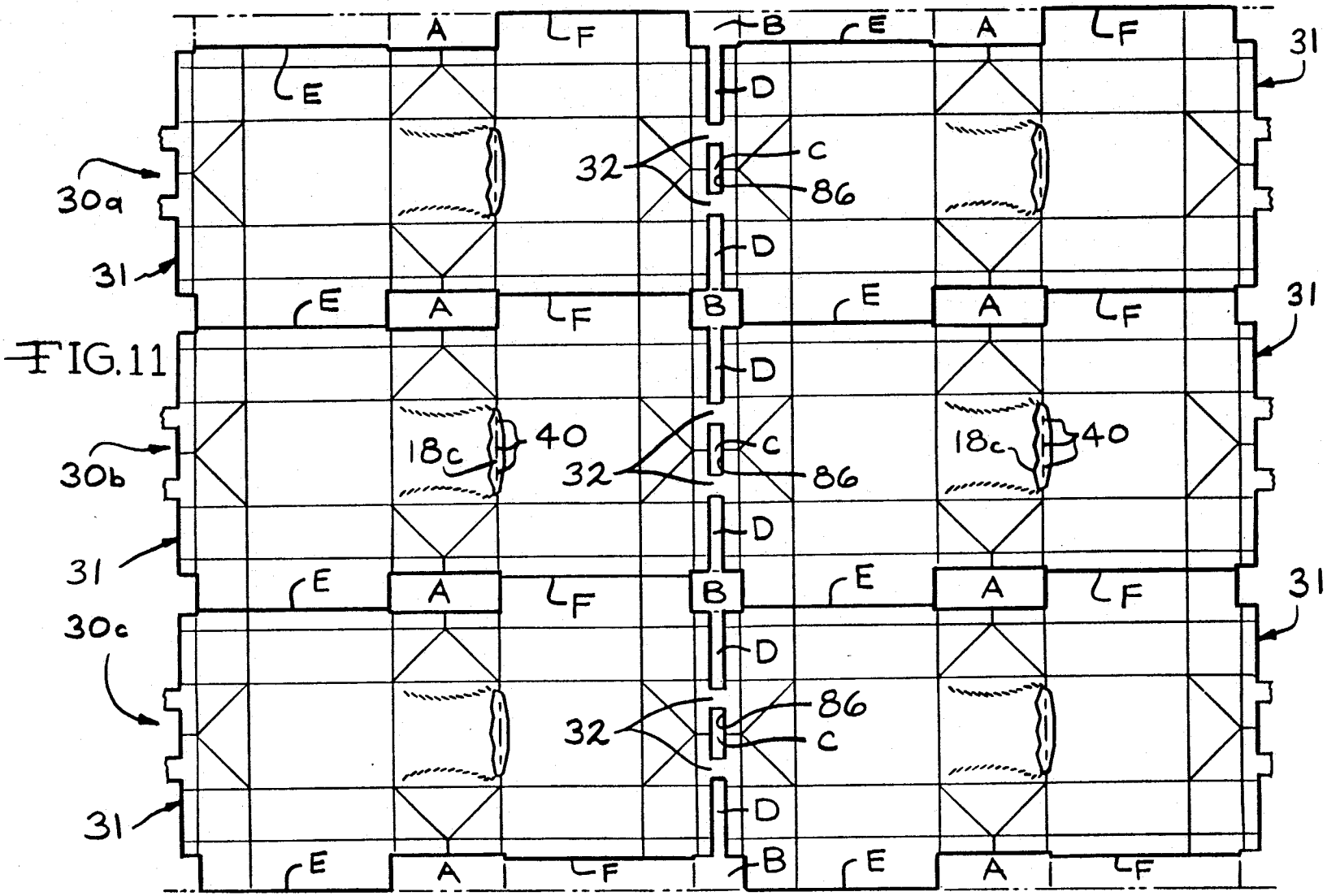
FIG. 11 is a plan view of a section of the paper sheet taken in the direction 11—11 of FIG. 3, and showing the paper after a plurality of punching and scoring operations have been performed on the paper to produce a plurality of longitudinally connected blanks for forming the individual packages.

Referring back to the schematic diagram of FIG. 3, paper from the supply roll 20 is sequentially fed through a plurality of stations adapted to perform various punching and scoring operations on the paper roll in order to produce individual blanks from which the package of the present invention can be formed. For example, in FIG. 11, there is shown a plan view of a longitudinal section of the paper sheet 22 after certain punching and scoring operations have been performed. In FIG. 11, the sheet of paper has been transformed into a plurality of three individual strips of paper 30*a*, 30*b*, and 30*c*, each including a plurality of individual blanks 31 which are longitudinally connected by means of a pair of connecting webs 32.

Figure 9:
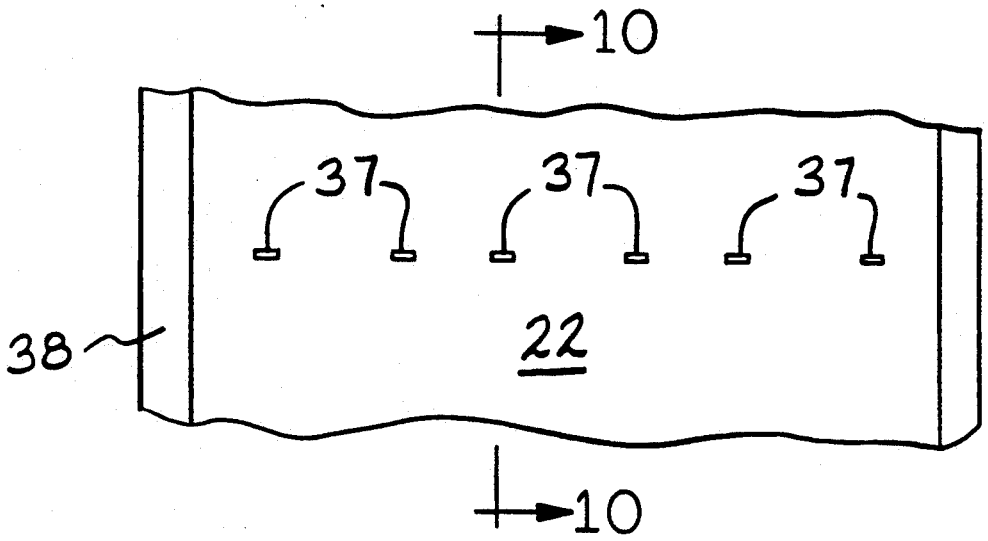
FIG. 9 is a side view taken in the direction 9—9 as shown in FIG. 3, and showing the paper sheet wrapped around a paper indexing roll having a plurality of transversely extending pegs projecting through the paper.
Figure 10:
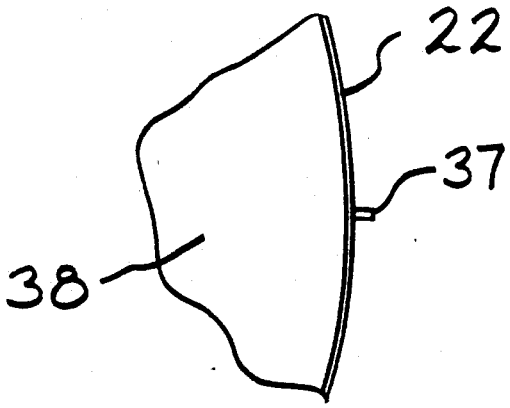
FIG. 10 is a sectional view taken along the line 10—10 of FIG. 9, and showing one of pegs of the indexing roll projecting through the paper sheet.

In order to achieve the arrangement shown in FIG. 11, the paper sheet 22 from the paper supply roll 20 must be fed through a plurality of individual punching, scoring, and cutting stations. As shown in FIG. 3, the paper sheet 22 is first fed through a punching station 34 wherein rectangular areas A and B, shown in FIG. 11, are initially punched from the paper sheet 22. Next, the paper sheet 22 is fed to a scoring station 35, wherein a predetermined pattern of scoring or folding lines, which assist in folding the package, are pressed into each individual blank 31. The particular configuration of the scoring lines will be discussed in more detail hereinafter. In FIG. 11, the scoring lines are represented by relatively thin solid lines, while the cut edges of the blank 31 are represented by relatively thick solid lines. Sections which have been removed are shown in phantom. After the scoring operation, the paper is indexed to a punching station 36. At this point, the individual H-shaped peg receiving portions 24*a* broken to provide a plurality of transversely aligned peg-receiving slots. These peg-receiving slots are then engaged by a plurality of transversely aligned peg members 37 (shown in FIG. 9) located on an indexing wheel 38. As shown in FIG. 10, the peg members 37 extend through the paper 22. The indexing wheel 38 maintains the sheet of paper in registration with the individual operating stations as the paper is fed through the first portion of the machine. While not shown in FIG. 3, it will be appreciated that other drive rollers can be utilized to assist the indexing wheel 38 in feeding the paper sheet 22.

In addition to punching the H-shaped portion 24*a*, the station 36 is also operative to punch one or more slits 40 in the plastic window 18*c* section. As will be discussed, the slits 40 (which can be seen in more detail in FIG. 17) assist in the subsequent welding of the window 18*c* to the associated opening tab 17 by allowing air which may be entrapped between the window and the opening tab to escape during the welding operation.

From the indexing roll 38, the paper sheet 22 is fed to a punching station 41 at which point the rectangular sections C and D, shown in FIG. 11, are removed from the sheet. Next, the paper is indexed to cutting station 42, wherein longitudinal cuts E and F are made to separate transversely adjacent blanks 31 from one another. After the cutting operation is performed by the station 42, the sheet 22 will have a configuration as shown in FIG. 11.

Figure 12:
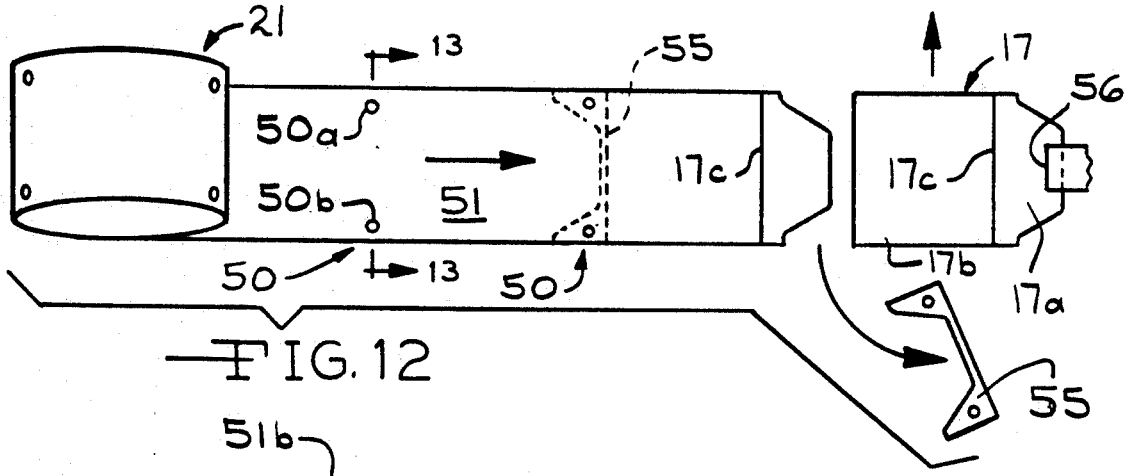
FIG. 12 is a view taken along the line 12—12 of FIG. 3 and showing the tab supply roll along with a schematic representation of how the individual opening tabs are formed.

At this point, the opening tab 17 can be secured to each individual blank 31. The opening tab 17 is fabricated from the tab supply roll 21 shown in FIG. 3. The particular construction of the tab supply roll 21 and the method by which the individual opening tabs 17 are constructed is shown in FIG. 12. Preferably, the number of separate tab supply rolls 21 which are required correspond to the number of package blanks 31 which are simultaneously produced by the machine. Thus, for the embodiment described herein, which simultaneously produces three packaging blanks 31, three separate tab supply rolls 21 are utilized. However, for simplicity, only one such tab roll 21 is shown in FIG. 3.

Figure 13:
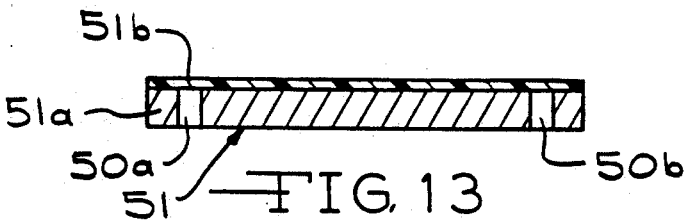
FIG. 13 is a sectional view taken along the line 13—13 of FIG. 12 and showing the tab supply roll as including transversely spaced apart apertures which function as indexing and registration means.

Referring now to FIG. 12, the tab supply roll 21 provides a longitudinal strip 51 of paperboard material having a plurality of longitudinally spaced part indexing means 50 punched therein during the manufacturing and printing of the paper material. In FIG. 12, the indexing means 50 comprises a pair of transversely spaced apart cylindrical apertures 50*a* and 50*b* which, in the preferred embodiment as shown in the sectional view of FIG. 13, extend completely through both a paper layer 51*a* an inner plastic layer 51*b*. It will be appreciated that, in some instances, it may be desirable to only punch the apertures through the paper layer 51*a*. The outside surface of the tab strip 51 is typically provided with a moisture resistant coating (not shown) such as a waterproof lacquer material, or an outside plastic layer (also not shown).

As shown in FIG. 3, the paper strip 51 from the tab roll 21 is indexed and is maintained in registration by means of a tab indexing wheel 52 having a plurality of circumferentially spaced pairs of cylindrical pegs 53 which are adapted to be inserted in the cylindrical apertures 50*a* and 50*b*. The tab strip is then fed through a punching and scoring station, generally indicated in FIG. 3 at 54, wherein a predetermined section of the tab, shown as section 55 in FIG. 12, is punched from the strip to separate one of the opening tabs 17 from the end of the strip. Simultaneously with the punching operation, a transverse fold line 17*c* (which connects the tab top portion 17*b* with the front tab portion 17*a*) can be formed in the one end of the tab strip 51. Also, while not shown in the drawings, it may be desirable to emboss a predetermined decorative pattern on the top tab section 17*b* to improve the appearance of the final package.

Figure 14:
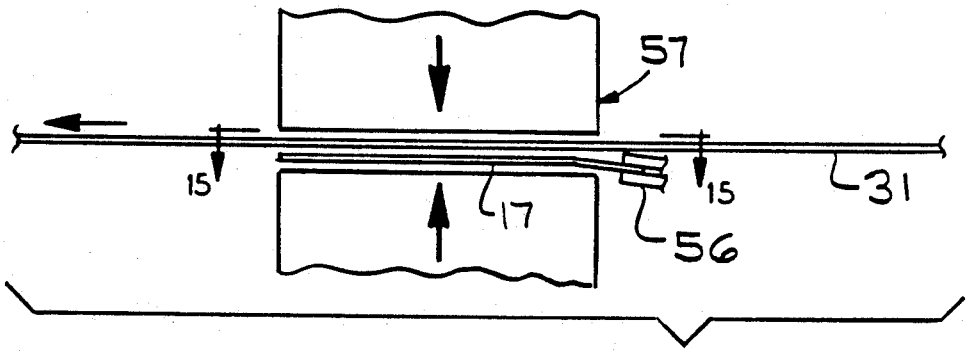
FIG. 14 is a schematic view illustrating the manner of ultrasonically fastening the opening tab formed in FIG. 12 at a selected location on the outer surface of the associated package blank.
Figure 15:
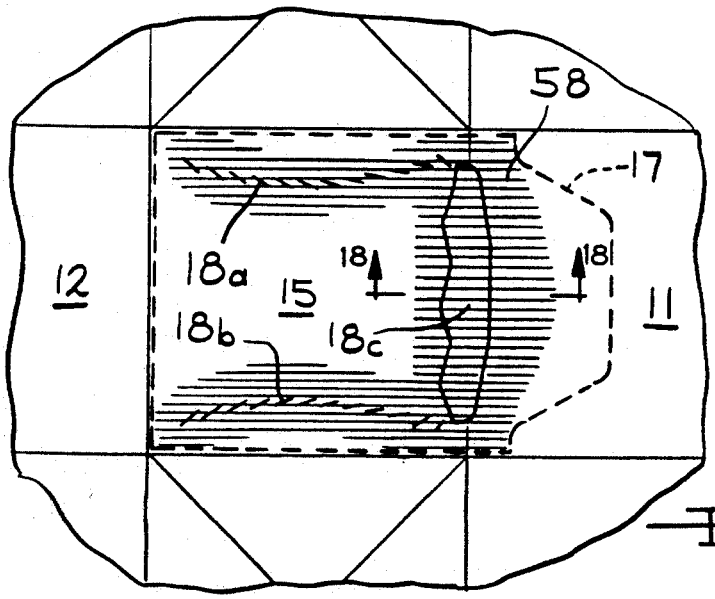
FIG. 15 is a plan view taken along the line 15—15 of FIG. 14 and showing a portion of the package after the tab has been ultrasonically secured to an outer surface of the package blank.

After the opening tab 17 has been formed in the manner as shown in FIG. 12, the front portion 17*a* of the tab 17 can be grasped by a pair of gripping fingers 56 (shown in FIGS. 3 and 12), which can be connected to a suitable mechanism for positioning the opening tab 17 under the appropriate portion of the package blank. For example, a plurality of gripping fingers 56 can be utilized to simultaneously grasp three opening tabs and move them into position under the appropriate one of the three simultaneously formed blanks. Once the tabs have been moved under the appropriate sections of the associated blanks, they can be securely fastened to the outside surface of the blanks. It has been found that an ultrasonic welding unit (shown in FIGS. 3 and 14 at 57) provides the preferred method of securing the tab to the blank. The ultrasonic unit 57 can be used to weld the tab 17 completely around the window 18*c* and also completely over the first and second tear lines 18*a* and 18*b* as represented by the shaded area 58 shown in FIG. 15.

Figure 16:
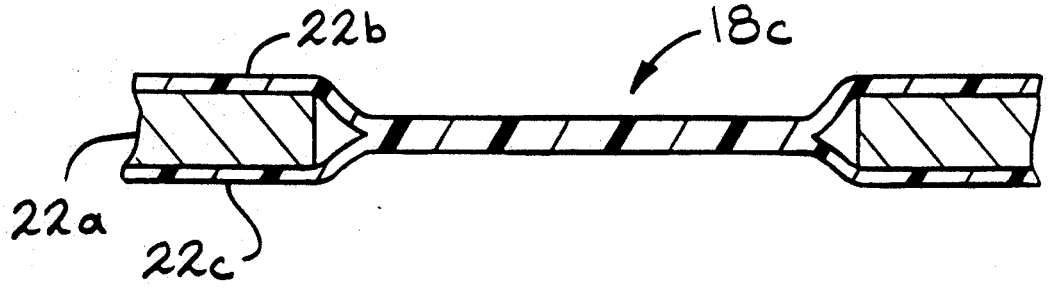
FIG. 16 is a sectional view taken along the line 16—16 of FIG. 5, and showing the window which is formed by the inner and outer plastic layers which extend across an opening in the center paper layer.
Figure 17:
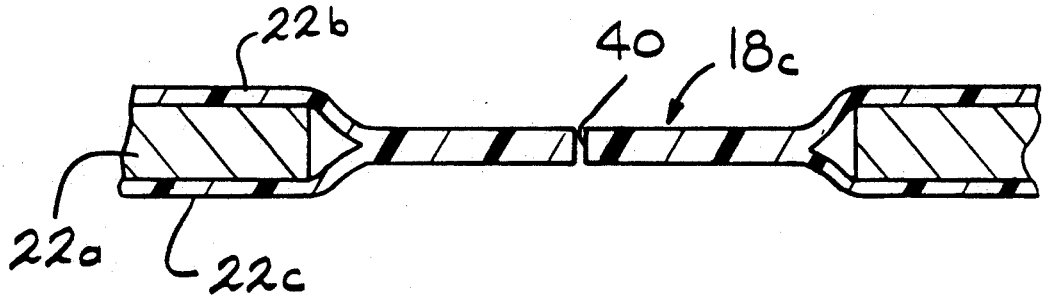
FIG. 17 is a sectional view, similar to FIG. 16, but showing the window after an air permeable slit has been formed therein.
Figure 18:
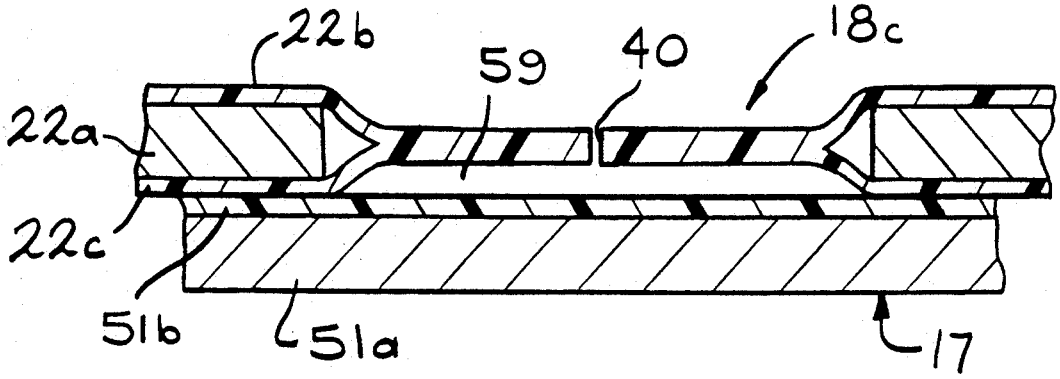
FIG. 18 is a sectional view taken along the line 18—18 of FIG. 15 after the tab has been ultrasonically secured to the outside of the package blank but prior to the window welding operation, and showing the air permeable slit formed in the window to enable air trapped between the tab and the window to escape.
Figure 19:
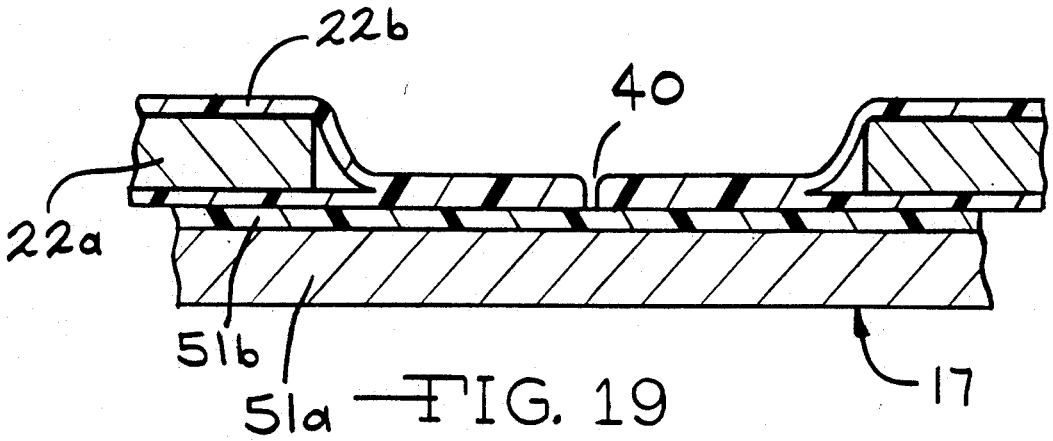
FIG. 19 is a sectional view, similar to FIG. 18, but showing the blank structure after the plastic window has been securely fastened to the inner surface of the tab.
Figure 20:
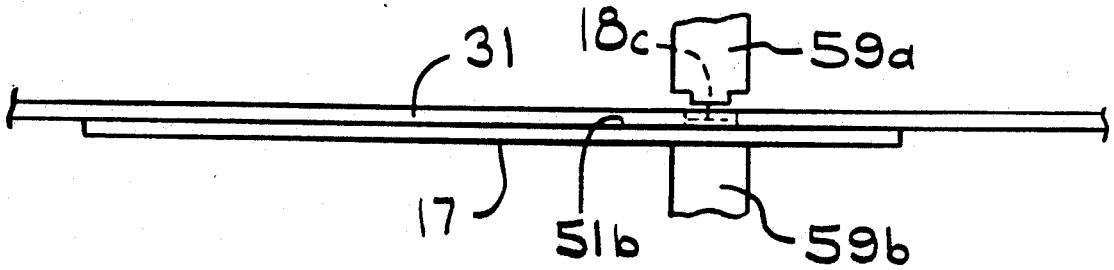
FIG. 20 is a side view illustrating the manner in which the plastic window of the package blank is securely welded to the inner plastic layer of the opening tab.
Figure 22:
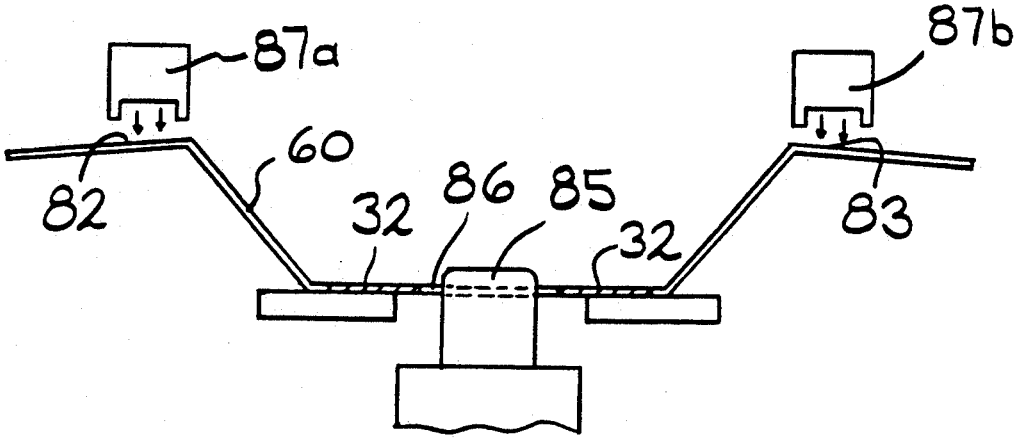
FIG. 22 is a sectional view taken along the line 22—22 of FIG. 3 and showing the position of the air heaters utilized to heat the longitudinally extending side seals.

After the tab has been secured to the outside surface of the blank, the plastic window 18*c* must be securely welded to the inside plastic layer 51*b* of the tab 17. This welding operation along with the previous operations of forming the plastic window, punching the window slit 40 and ultrasonically welding the tab 17 to the blank, are illustrated in FIGS. 16–19. FIG. 16 shows a sectional view through the window 18*c* as it is initially formed, while FIG. 17 illustrates the window 18*c* after the slit 40 has been cut therein. After the tab 17 is ultrasonically welded to the blank, as shown in FIG. 18, the window 18*c* is typically spaced upwardly from the inside surface of the tab to define an air space therebetween generally indicated in FIG. 18 by reference numeral 58. In order to provide a means of evacuating the air space 58 when the window is welded to the tab, the slit(s) 40 are cut in the window 18c. In order weld the window to the tab, the blank is positioned between a pair of heated welding jaws 59a and 59b as shown in FIG. 20, and the upper welding jaw 59a is then moved downwardly to engage the plastic window 18c and force the plastic window against the inside plastic layers 51b of the tab 17. This causes the window plastic to be securely welded to the inner plastic surface of the tab, as shown in FIG. 19, to make the inside surface of the container liquid tight.

Prior to discussing the remaining steps required to form the package of the present invention, the various panel sections and fold lines of an individual blank will be discussed with reference to a blank 60 shown in FIG. 21, which is a plan view of the inside surface of the blank 31 of FIG. 11 after the opening tab 17 has been secured thereto. As previously mentioned, the blank 60 has been precut by the machine into the predetermined configuration shown in FIG. 21 and is provided with a plurality of fold lines which are illustrated in FIG. 21 as relatively thin solid lines within the outer periphery of the blank. The fold lines define locations along which the sheet is either temporarily or permanently folded during the construction of the package. The blank shown in FIG. 21 is provided with longitudinal fold lines 61, 62, 63, and 64, and transverse fold lines 65, 66, 67, 68, 69, and 70. The blank shown in FIG. 21 also includes the first and second tear lines 18a and 18b having their one ends connected to the end sections 18d and 18e of the plastic window 18c. The opening tab 17, which has been secured to the outside surface of the blank, is shown in dashed form.

As shown in FIGS. 1 and 31, the completed package 10 includes three panel which are formed from a continuous and seamless layer of laminated paper material. These three panels, which are also shown in FIG. 21, include the top panel 15, the front panel 11 and the rear panel 12. The top panel 15 is of a square configuration and is bounded by the longitudinal fold lines 62 and 63 and the transverse fold lines 67 and 68. The front panel 11 is defined by the longitudinal fold lines 62 and 63 and the transverse fold lines 66 and 67. The rear panel 12 is defined by the longitudinal fold lines 62 and 63 and the the transverse fold lines 68 and 69.

The first side panel 13 (shown in FIGS. 2 and 31) is formed front and rear first side extensions 71 and 72 which are connected to the front and rear panels 11 and 12 respectively along the fold line 62. In particular, the front first side extension 71 is bounded by the longitudinal fold line 62 and the transverse fold lines 66 and 67. The rear first side extension 72 is bounded by the longitudinal fold line 62 and the transverse fold lines 68 and 69. In a similar manner, the second side panel 14 (shown in FIG. 1) is formed by the cooperation of front and rear second side extensions 74 and 75. The front second side extension 74 is connected to the front panel 11 along the fold line 63, and is located between transverse fold lines 66 and 67. The rear second side extension 75 is connected to the rear panel 12 along the fold line 63 and is located between the transverse fold lines 68 and 69.

A first top panel extension 76 is connected to the top panel 15 along the fold line 62 and is located between the transverse fold lines 67 and 68, while a second top panel extension 77 is connected to the top panel 15 along the fold line 63 and is also located between the transverse fold lines 67 and 68.

The bottom panel 16 (shown in FIG. 31) is formed from the cooperation of front and rear bottom extension 78 and 79. The front bottom extension 78 represents the upper portion of the blank 60 shown in FIG. 21 and is foldably connected to the front panel 11 and the front first and second side extensions 71 and 74 along the fold line 66. A rear bottom panel portion 79 is located along the bottom of the blank in FIG. 21 and is foldably connected to the rear panel 12 and the rear first and second side extensions 72 and 75 along the fold line 69.

The particular operations associated with folding and sealing the blank of FIG. 21 into a liquid tight rectangular paper board container will now be discussed. Initially, the blank is prefolded along longitudinal score lines 61, 62, 63, and 64 in a manner shown in FIG. 23. This operation can be performed at an initial folding station 80 shown in FIG. 3. In particular, the panel portions of the blank located between the fold lines 61 and 62 and between the fold lines 63 and 64 are folded upwardly, while those panel portions located on the outside of the fold lines 61 and 64 are folded downwardly to form a trough-shaped blank as shown in FIG. 23.

Figure 23:
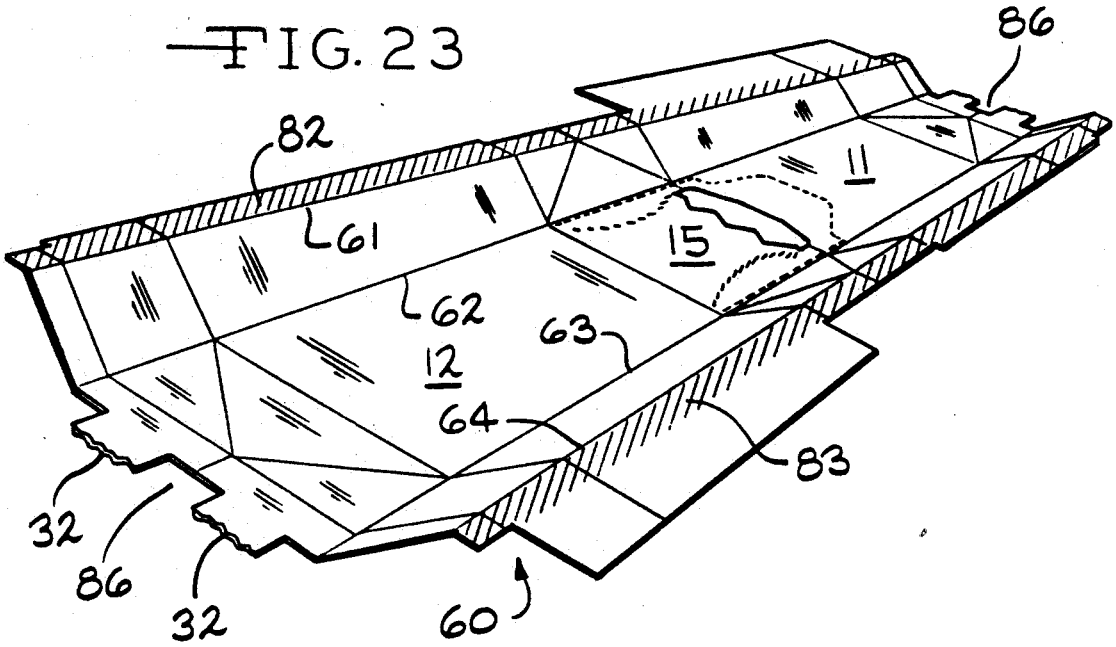
FIG. 23 is a perspective view illustrating the initial folding operation in forming the package wherein the package is folded along the longitudinal fold lines.

Next, the blanks are advanced through a hot air heating system 81 (shown in FIG. 3) wherein the longitudinally extending side sealed areas, shown in FIG. 23 as the shaded areas 82 and 83 are heated to cause the polyethylene coating thereon to melt. The individual rows of longitudinally connected blanks can be advanced through the heating system 81 by means of an endless chain 84 carrying individual hooks 85 which project up into the opening 86 (also shown in FIG. 11) between the connecting webs 32. It will be appreciated that the overall length of the heating system will be a function of the cycle speed of the machine, along with the heating capacity of the associated longitudinally extending hot air heaters 87a and 87b. It will also be appreciated that the hot air heaters 87a and 87b can run continuously, such that as the blanks are advanced through the heating system, the longitudinal side seal areas will continuously be heated.

Figure 24:
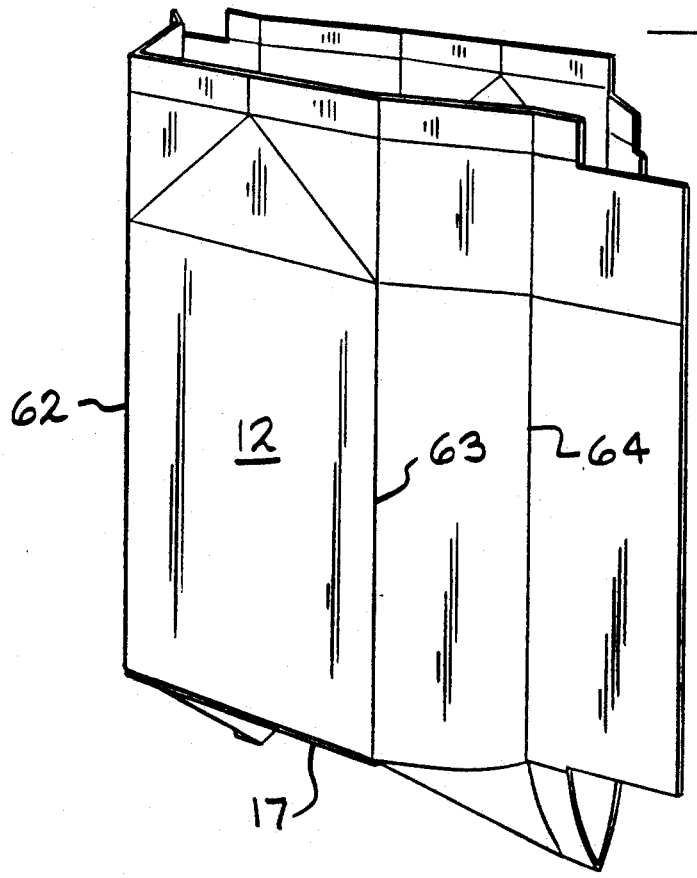
FIG. 24 illustrates the first step in forming the rectangular-shaped package wherein the side walls are folded upwardly to a perpendicular position relative to the bottom wall.
Figure 25:
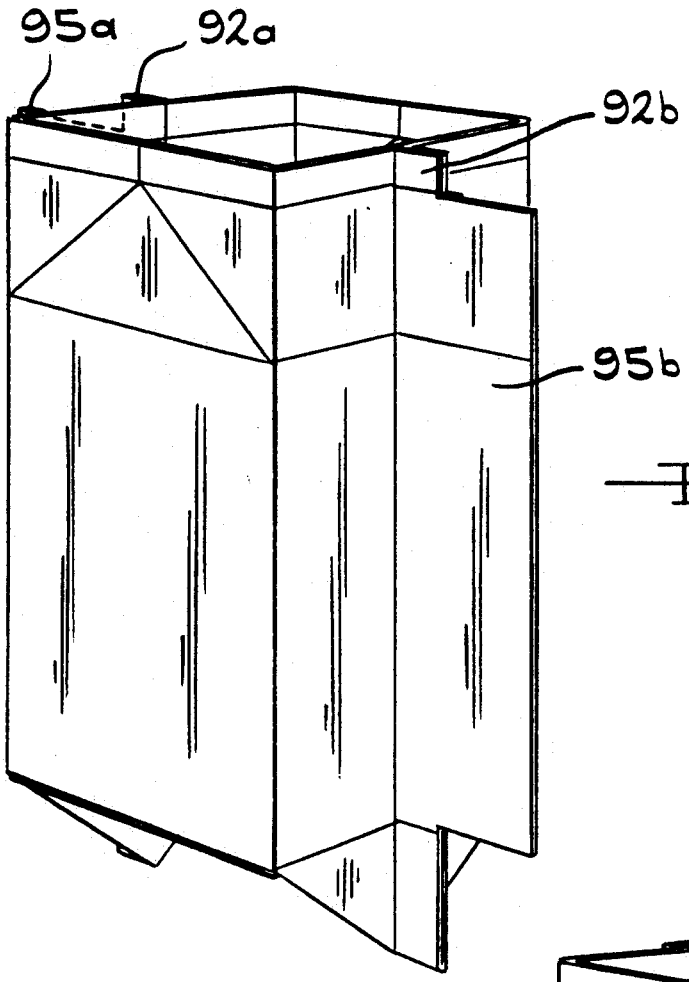
FIG. 25 is a bottom perspective which illustrates a subsequent fabrication step wherein extension portions of the side panels are forced toward one another and sealed together to form a pair of side panels having vertically extending side fin seals.

From the heating system 81, the blanks are fed through a punching station 88 at which point the connecting webs 32 are punched to separate the individual blanks 60 from the ends of the strips 30a, 30b and 30c. A rectangular mandrel 89, shown in FIG. 3, can then be moved downwardly to engage the inner surface of the top panel 15, and force the blank through a pair of fixed curved forming blocks 90a and 90b. This causes the front and rear panels 11 and 12 to be forced upwardly relatively to the top panel and results in the package being folded in a manner as shown in FIG. 24. It should be noted that, when viewing FIGS. 24–31, the partially assembled packages are inverted from their normally used position, i.e., the top panel 15 and opening tab 17 face downwardly, and the bottom portion of the package faces upwardly. Once the package is in this position, a pair of side sealing jaws 91a and 91b can be moved toward one another to form the first and second side fin seals 92a and 92b as shown in FIG. 25.

Figure 26:
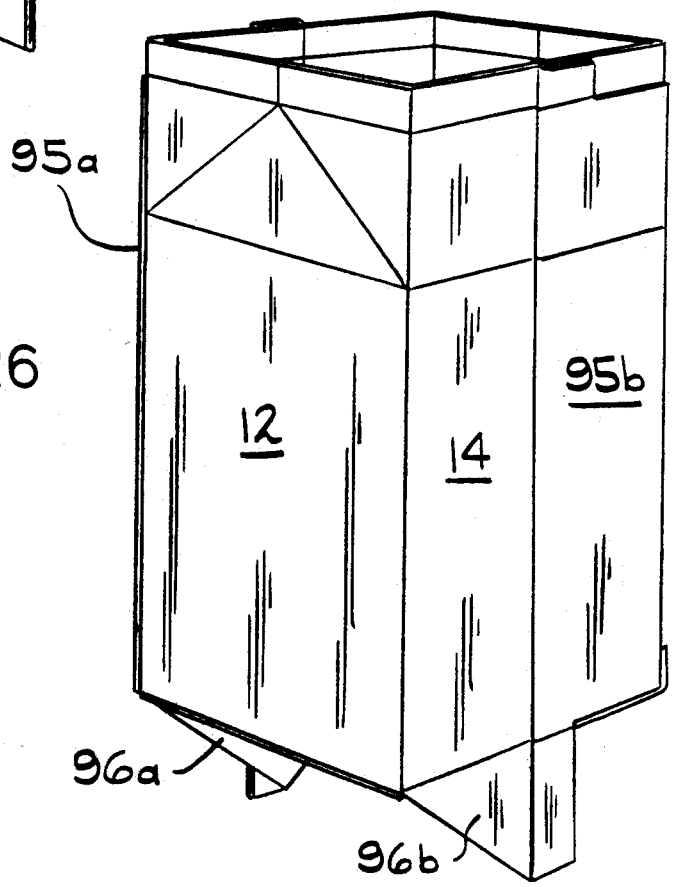
FIG. 26 is a bottom perspective view which shows a subsequent fabrication step in which wing portions extending from the side fin seals are folded against the side panels to cover and protect the side fin seals while providing uninterrupted side printing surfaces.
Figure 27:
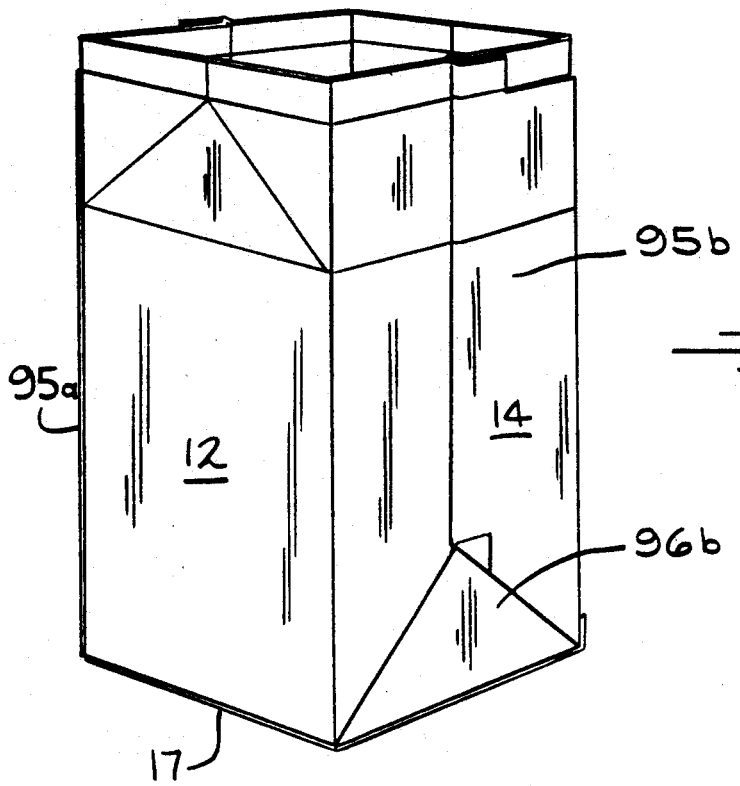
FIG. 27 illustrates a further step in the assembly of the package, in which the downwardly extending ear portions of FIG. 26 are folded upwardly against the side panels.
Figure 28:
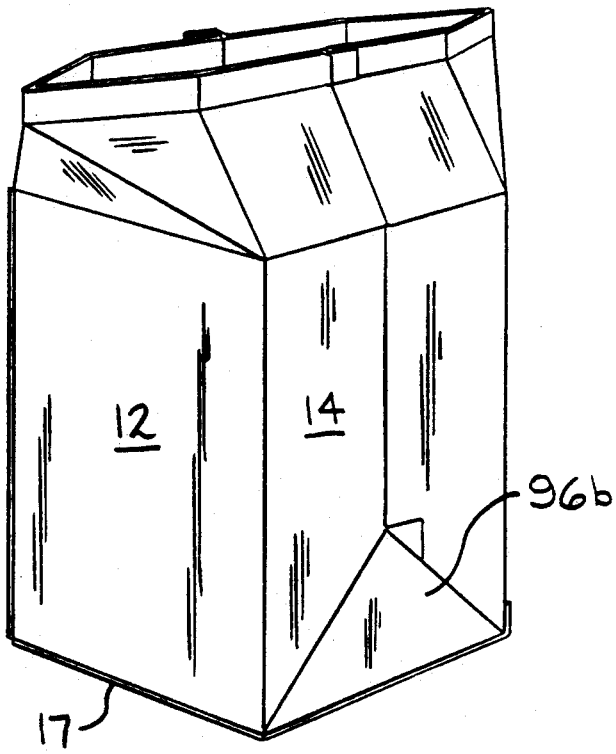
FIG. 28 illustrates the next step in forming the package of the invention, wherein the bottom fold lines of the package are prefolded prior to filling the package with a product.
Figure 29:
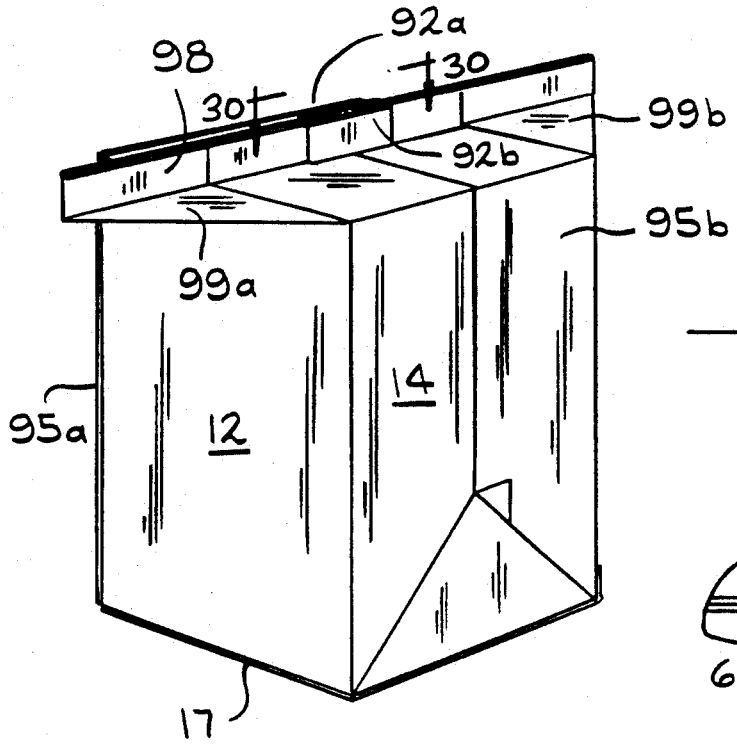
FIG. 29 illustrates the step of sealing the bottom of the package, wherein a single center seal is formed across the bottom transverse to the side fin seals.
Figure 30:
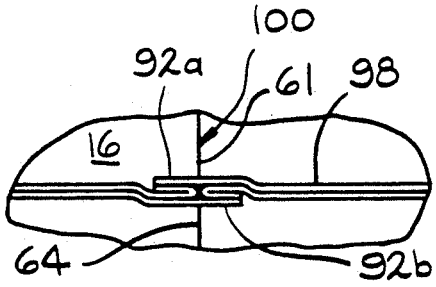
FIG. 30 is a top view taken in the direction 30—30 of FIG. 29, and showing the manner in which the bottom ends of the side fin seals are folded within the transverse bottom seal.

The open ended package can then be removed from the mandrel 89 by a vacuum arm 93 which can be utilized to transfer the package to a wing and ear fold and seal station 94. This station is first operative to fold the side panel wings 95a and 95b, shown in FIG. 25, against the first and second side panels 13 and 14, respectively, to produce the package as shown in FIG. 26. Next, the downwardly extending triangular ears, shown in FIG. 26 at 96*a* and 96*b*, can be folded upwardly against the first and second side panels 13 and 14, respectively, to produce the container of FIG. 27. The open ended package can then be transferred to a fill and seal station 97, wherein the bottom panel sections are initially broken along the associated fold lines as shown in FIG. 28, the package is filled with the product, and is then sealed in a manner as shown in FIG. 29 to produce a bottom fin seal 98 which extends transversely relative to the side fin seals 92*a* and 92*b*. It should be noted that, since one side wing flap is folded forwardly and the other wind flap is folded rearwardly, the bottom fin seal 98 will have a configuration as shown in FIG. 30, wherein the bottom ends of the side fin seals 92*a* and 92*b* are adjacent one another, but are located on opposite sides a center reference line 100, which is colinear with the portions of the fold lines 61 and 64 located in the bottom panel 16. The bottom fin seal 98 can then be folded downwardly against the bottom of the container, and the bottom triangular ears 99*a* and 99*b* can be folded first upwardly and then downwardly against the bottom of the package to complete the package as shown in FIG. 31.

Figure 32:
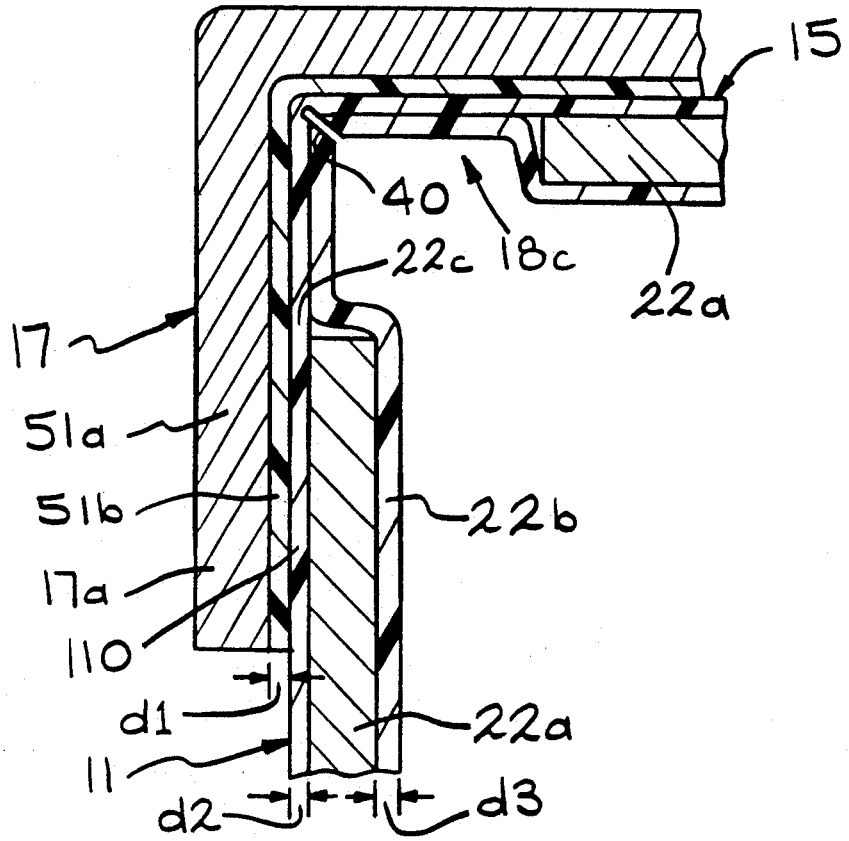
FIG. 32 is a sectional view taken along the line 32—32 of FIG. 1, and showing the manner in which the opening tab is sealed over the windows.
Figure 33:
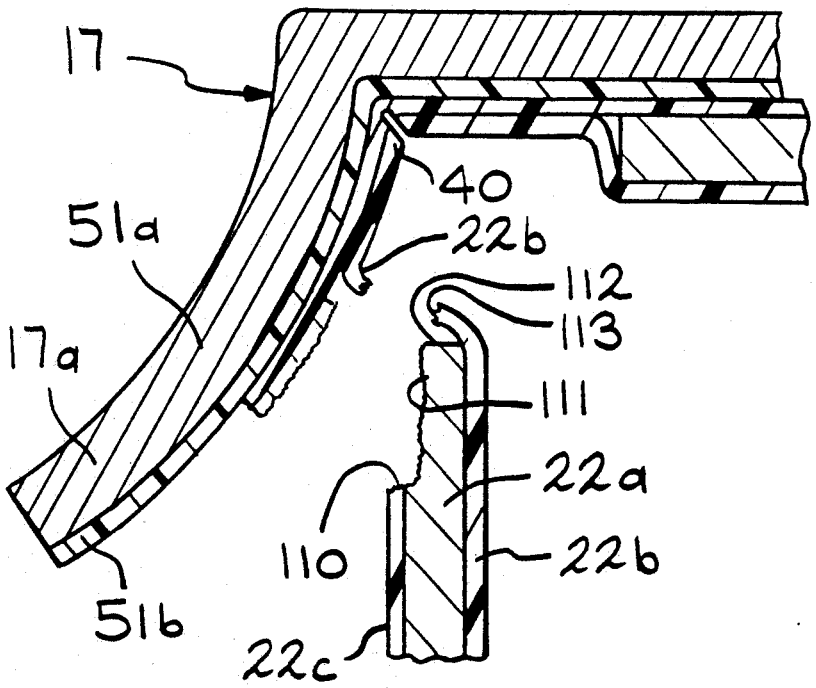
FIG. 33 is a sectional view, similar to FIG. 32, but showing the manner in which the lower window edge is broken as the opening tab is lifted upwardly.

Referring now to FIGS. 32 and 33, the opening operation of the package will be reviewed. FIG. 32 is a sectional view which illustrates the manner in which the plastic window 18*c* has been welded to the inside plastic layer of the opening tab. In addition, the inside plastic layer 51*b* of the tab 17 has been ultrasonically welded to the outside plastic layer downwardly along the front face of the front panel to a point 110, and has been ultrasonically welded to the top panel over the first and second tear lines. When the opening tab 17 is pulled upwardly as shown in FIG. 33, the outer plastic layer 22*c* will break at point 110 and the break will continue into the interior of the center paper layer 22*a* along a tear line 111. Upon reaching the upper edge 112 of the front panel 11, the break will occur at a point 113 in the inner plastic layer 22*b*.

In order to ensure that the package breaks in a manner as shown in FIG. 3, it is important that the inner and outer plastic layers 22*b* and 22*c* of the package blank and the inner plastic layer 51*b* of the opening tab have certain thicknesses relative to one another. First, in order to ensure that the outer plastic layer 22*c* of the package will break at the point 110 such that the tear continues into the center paper layer 22*a*, it is desirable that the thickness d2 (and/or strength) of the outer plastic layer 51*b* be less than the thickness d1 (and/or strength) of the inner plastic layer 51*b* of the opening tab. Otherwise, if the plastic layer of the opening tab was weaker or thinner than the outer plastic layer of the package, the break may occur through the plastic layer 51*b* and continue into the tab paper layer 51*a*. Further, in order to ensure that the break occurs in the inner plastic layer 22*b* at the point 113, it is desirable that the thickness d3 (and/or strength) of the inner plastic layer 22*b* be less than the combined thicknesses (d1 and d2) and/or strength of the outer layer 22*c* and the inner tab layer 51*b*, respectively.

While the package of the present invention has been illustrated and described as having specific unique opening top, side panel and bottom panel constructions, it will be appreciated that these particular unique features can be used either individually or in the combination as described above.

Also, while the package is described and claimed herein as being generally rectangular or parallelepiped, it will be appreciated, that in some instances, it may be desirable to attach a handle or spout to the package either during or subsequent to the construction of the package. Further, the method of the present invention can be used to produce other types of rectangular paperboard packages.

The present invention has been illustrated and described in what is considered to represent its preferred embodiment. However, it will appreciated that other modifications and variations can be made to this embodiment without departing from the scope of the attached claims.

What is claimed:

1. A method of forming a paperboard package comprising the steps of:

(a) providing a longitudinally extending sheet of laminated paperboard material including a paper layer having a thermoplastic layer applied to at least one surface thereof;

(b) scoring the sheet to form a predetermined pattern of fold lines defining a series of longitudinally connected individual blanks for forming separate paperboard packages;

(c) heating the thermoplastic layer of at least the endmost blank along first and second transversely spaced and longitudinally extending side seal areas while the blank remains connected to the sheet;

(d) severing the endmost blank from the sheet while the first and second side seal areas remain heated; and (e) folding the severed blank into an open ended rectangular configuration wherein portions of the heated first side seal area are urged into sealing engagement with one another and wherein portions of the second side seal area are urged into sealing engagement with one another.

2. The method according to claim 1 and including the step of providing the sheet with a plurality of uniformly longitudinally spaced indexing means, with each indexing means including at least one peg receiving portion, and further including the step of feeding the sheet in a longitudinal direction by means of an indexing wheel having peg members engageable with the peg receiving portions of the sheet.

3. The method according to claim 2 and further including the step of providing the sheet with a plurality of uniformly longitudinally spaced hook engaging openings, and wherein at least one longitudinally moveable hook member is engageable with one of the hook engaging openings to assist the indexing wheel in feeding the sheet in a longitudinal direction.

4. The method according to claim 3 wherein a separate hook engaging opening is provided between each successive pair of longitudinally connected blanks.

5. The method according to claim 1 wherein, prior to step (c), side portions of the blank are prefolded upwardly along transversely spaced and longitudinally extending fold lines to form a trough-shaped blank wherein the first and second side seal areas are elevated relative to a central longitudinally extending portion of the blank.

6. The method according to claim 1 wherein step (b) forms a plurality of transversely adjacent individual blanks.

7. The method according to claim 6 wherein, prior to step (c), transversely adjacent blanks are separated from one another.

8. The method according to claim 1 including, prior to step (d), the step of attaching an opening means to a portion of at least one individual blank.

9. The method according to claim 8 wherein the opening means includes an opening tab constructed of laminated paperboard material.

10. A method of forming a paperboard package comprising the steps of:

(a) providing a blank constructed of a longitudinally extending sheet of laminated paperboard material including a paper layer having a thermoplastic layer applied to at least one surface thereof, the blank having a predetermined pattern of fold lines defining a top panel, a front panel, and a rear panel, the top panel connected to the front panel by a transversely extending front fold line and the top panel connected to the rear panel by a rear fold line parallel and spaced from the front fold line, the plurality of fold lines further including two outermost transversely spaced and longitudinally extending seal fold lines which cooperate with longitudinal edges of the blank to define thermoplastic coated first and second side seal areas;

(b) folding the first and second side seal areas of the blank along the seal fold lines to form a prefolded blank;

(c) centrally folding the blank by maintaining the top panel generally flat while simultaneously folding the front and rear panels along the front and rear fold lines and into perpendicular relationship to the top panel and into parallel relationship with one another such that portions of the first side seal area are in generally spaced apart and facing relationship and portions of the second seal area are in generally spaced apart and facing relationship; and (d) urging the facing portions of the first side seal area into sealing engagement with one another and urging the facing portions of the second side seal area into sealing engagement with one another to form an open-ended rectangular paperboard container.

11. The method according to claim 10 and including the step of securing an opening attachment to the top panel.

12. The method according to claim 11 wherein the opening attachment is a tab constructed of sheet material.

13. The method according to claim 10 and including the step of heating the first and second side seal areas to melt and weld the respective facing portions thereof.

14. The method according to claim 13 wherein the heating step is performed prior to said step (c).

15. The method according to claim 10 wherein said step (a) includes the steps of providing a series of longitudinally connected blanks and severing the endmost blank immediately prior to effecting step (c).

16. The method according to claim 10 wherein said step (a) includes the step of providing a plurality of transversely adjacent individual blanks.

* * * * *